US006600966B1

(12) United States Patent
Bailie

(10) Patent No.: US 6,600,966 B1
(45) Date of Patent: Jul. 29, 2003

(54) SOFTWARE PROGRAM, METHOD AND SYSTEM FOR DIVIDING AN EMBROIDERY MACHINE DESIGN INTO MULTIPLE REGIONAL DESIGNS

(76) Inventor: Brian D. Bailie, 9913 Toltec NE., Albuquerque, NM (US) 87111

( * ) Notice: Subject to any disclaimer, the term of this patent is extended or adjusted under 35 U.S.C. 154(b) by 0 days.

(21) Appl. No.: 10/083,715

(22) Filed: Feb. 26, 2002

(51) Int. Cl.[7] ..... G06F 19/00; D05B 21/00
(52) U.S. Cl. ..... 700/138; 112/102.5
(58) Field of Search ..... 700/138, 136, 700/137, 132; 112/102.5, 470.06, 475.19

(56) References Cited

U.S. PATENT DOCUMENTS 6,237,516 B1 * 5/2001 Wakayama ..... 112/102.5
6,256,551 B1 * 7/2001 Muto ..... 700/138

* cited by examiner

*Primary Examiner*—Peter Nerbun
(74) *Attorney, Agent, or Firm*—Senniger, Powers, Leavitt & Roedel

(57) ABSTRACT

A software program, method and system for analyzing and dividing an embroidery design into multiple regional designs. An embroidery machine then uses the regional designs to create an embroidered fabric. The software separates the embroidery design into regional designs such that each regional design fits within a predefined region having a size which can be handled by the hoop and the attachment points of the embroidery machine. For each separate regional design, one or more files of executable instructions is created. The instructions are used by the embroidery machine to sew the embroidery design. In one form, region software analyzes the stitch data for its ability to exist in multiple, overlapped regions. Grid software divides the embroidery design to be analyzed into a plurality of grid sections. Identifying software identifies each grid section having a stitch that is partially or completely underlying another stitch. Modification software divides the stitches of the design into different embroidered regions.

23 Claims, 6 Drawing Sheets

SOFTWARE PROGRAM, METHOD AND SYSTEM FOR DIVIDING AN EMBROIDERY MACHINE DESIGN INTO MULTIPLE REGIONAL DESIGNS

BACKGROUND OF THE INVENTION

The invention relates to a software program and system for assisting an operator in analyzing and dividing an embroidery design into a plurality of regional designs that will be used by an embroidery machine to create an embroidered fabric. The invention is for use with embroidery designs which are too large for the machine to embroider in one section. In particular, the invention assists the operator by dividing the embroidery design into multiple regional designs which, when sewn together sequentially on a fabric or other base, correspond to the embroidery design.

It is quite often that a desired embroidery product will be larger than the size capable of a readily available embroidery machine. For example, the hoop size may be smaller that the design. When this occurs, the operator of the machine must either reduce the size of the design to fit the machine or hoop size, or manually using other software programs, called editors, divide the design into multiple sections. The first method, resizing, is not desirable because this changes the nature of the resulting embroidered product. The second option, manually splitting the design, is very time-consuming and quite often causes 'seams', which are lines where the segments overlap as they are sewn. This is an undesirable result.

There is a need for a system and method that divides embroidery designs automatically into multiple embroidered segments that will have a minimum of overlapped seams.

SUMMARY OF THE INVENTION

In one form, the invention includes a software program for dividing an embroidery design which is larger than a hoop of an embroidery machine for sewing the embroidery design. The software program divides an electronic representation of the embroidery design. The program comprises the steps of: defining dimensions of a region based on a size of the hoop and/or based a location of attachment points of the hoop to the embroidery machine;

overlaying the defined region onto the embroidery design; and creating a file which corresponds to at least one of the overlayed regions, the file comprising an executable set of instructions used by the embroidery machine to sew a regional design which corresponds to at least a portion of the embroidery design.

In another form, the invention includes a software program for dividing an embroidery design into predefined regions having a size based on a size of a hoop of the embroidery machine and/or based a location of attachment points of the hoop to the embroidery machine. The software program divides an electronic representation of the embroidery design. The program comprises the steps of:

separating the embroidery design into sections such that each section fits within one of the predefined regions; and creating for the separated sections an executable set of instructions used by the embroidery machine to sew the embroidery design whereby the embroidery machine sews the embroidery design by sequentially executing the instructions.

In yet another form, the invention comprises a system for dividing an embroidery design which is larger than a hoop of an embroidery machine for sewing the embroidery design. The system divides an electronic representation of the embroidery design. The system comprises a personal computer executing the following instructions:

defining dimensions of a region based on a size of the hoop and/or based a location of attachment points of the hoop to the embroidery machine;

overlaying the defined region onto the embroidery design; and creating a file which corresponds to at least one of the overlayed regions, the file comprising an executable set of instructions used by the embroidery machine to sew a regional design which corresponds to at least a portion of the embroidery design.

This software program, method and system of the invention has a number of advantages over the prior art. The software program, method and system provide an objective approach to dividing embroidery designs into multiple regional designs. Furthermore, the undesirable seams of manual splitting are minimized.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE PREFERRED EMBODIMENTS

Figure 1:
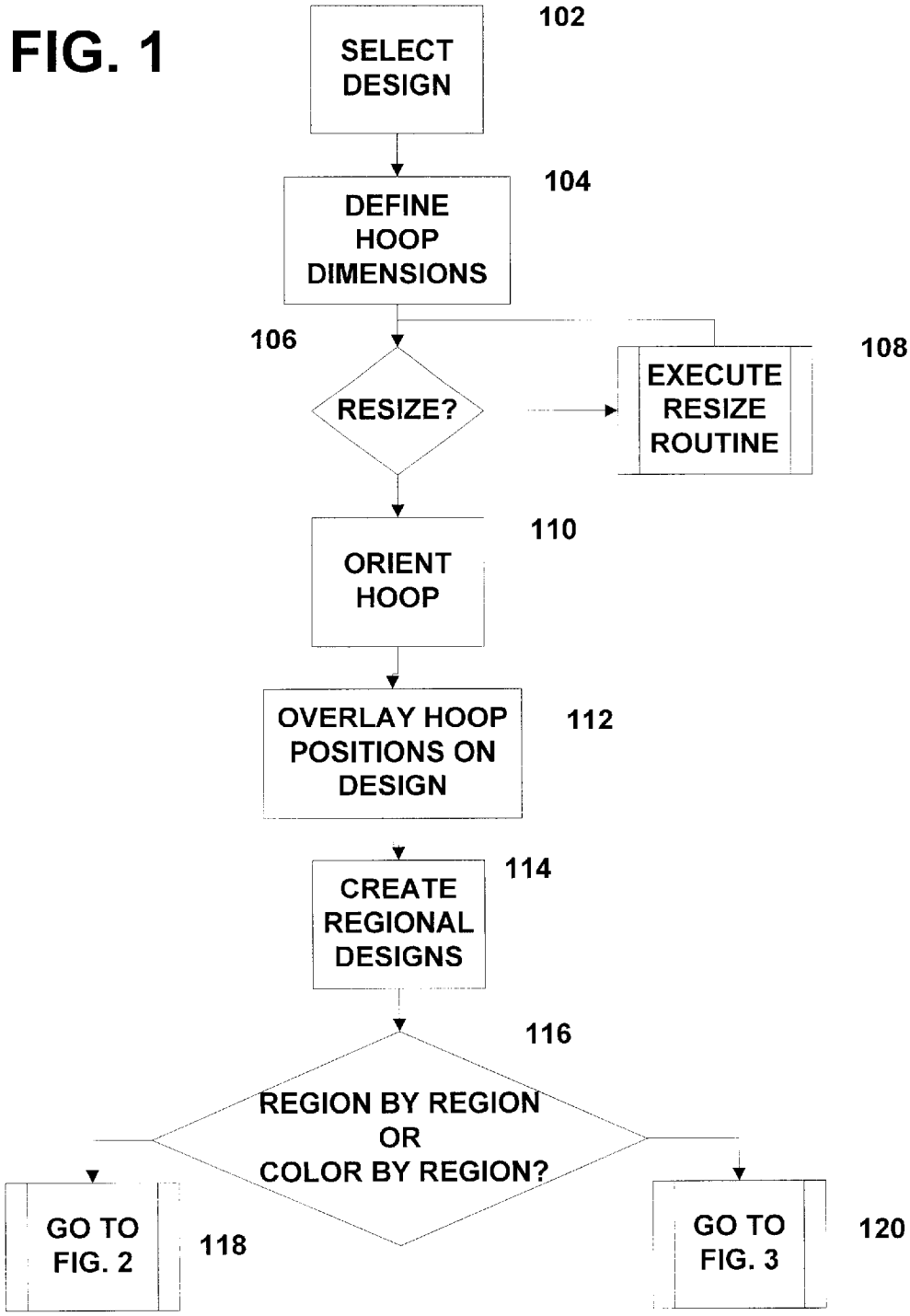
FIG. 1 is a flow chart of one preferred embodiment of the invention showing the initial steps of the software program, system and method of the invention leading up to the decision of (1) creating a collection of regional designs which can be sewn region by region, or (2) creating a collection of regional designs which can be sewn color by color.

One purpose of the invention is to provide a system, software and/or method which creates a set of data and/or a corresponding image on a computer that accurately represents the embroidery design that will be used by an embroidery machine to sew a series of regional designs to create an embroidered fabric. In one preferred form, the invention comprises software running on a personal computer which is linked to and controlling an embroidery machine. The software program, method and system analyzes the embroidery design and divides the design into multiple embroidered regions. In one form, the invention comprises a computer readable medium having computer executable instructions for performing the steps of the software program of the invention.

The following provides exemplary definitions of the terms used herein. These definitions are provided by way of example and not for the purpose of limiting the invention or the scope of the claims of the invention.

Definitions

Embroidery File is logically organized (although differently between manufacturers) into a series of individual stitches and colors. Embroidery usually takes place on a Cartesian plane, using the (x,y) coordinate system. For example, the needle of the embroidery machine will start at the origin (0, 0) and move in a series of steps, referred to as stitches. At the end of each step, the embroidery machine cycles the needle mechanism to form a stitch in the fabric. After completing a series of stitches with the same thread, the machine will stop and request a new thread (having a different color, thickness, composition or other different parameter).

Embroidery Region is an area which can be held by a hoop and sewn by an embroidery machine. It is designated by a rectangle whose corners are given in standard Cartesian coordinates. With respect to the embroidery design, this rectangle describes an area of the design that will be analyzed, or separated as a result of the invention.

Embroidery Hoops are used to anchor the fabric to the machine during the embroidering process. Each embroidery machine has a limitation to the size of the embroidery that it is capable of producing on a single design. The hoop for any given machine will likely be able to hold enough fabric area for the machine's entire embroidery region. In some cases, however, manufacturers of embroidery machines also supply hoops that can hold a larger region than the machine can embroider. With this type of hoop, it is common that the hoop has multiple points at which it will attach to the embroidery machine. These hoops are called Multi-Position Hoops. These multi-position hoops will have their attachment points arranged so that the embroidery regions within the hoop will overlap.

Multiple-Hooping during embroidery is a method of creating an embroidered fabric which has an embroidered area larger than the area of any single hoop available for the machine. The operator will embroider a single design region, then reposition the fabric in the hoop and embroider another region. This process repeats until the operator has a complete design.

Region-by-region embroidery occurs when an embroidery design, containing multiple colors is separated into a plurality of regional designs and each regional design is embroidered as a complete region before the next regional design is embroidered. That is, all colors for that region are embroidered before the hoop or fabric is moved to a different region. This process is required for ease-of-use on some embroidery machines.

Color-by-color embroidery occurs when a given color is embroidered in all of the regions required, having a multi-position hoop repositioned at stopping points between embroidering the different regions.

Figure 4:
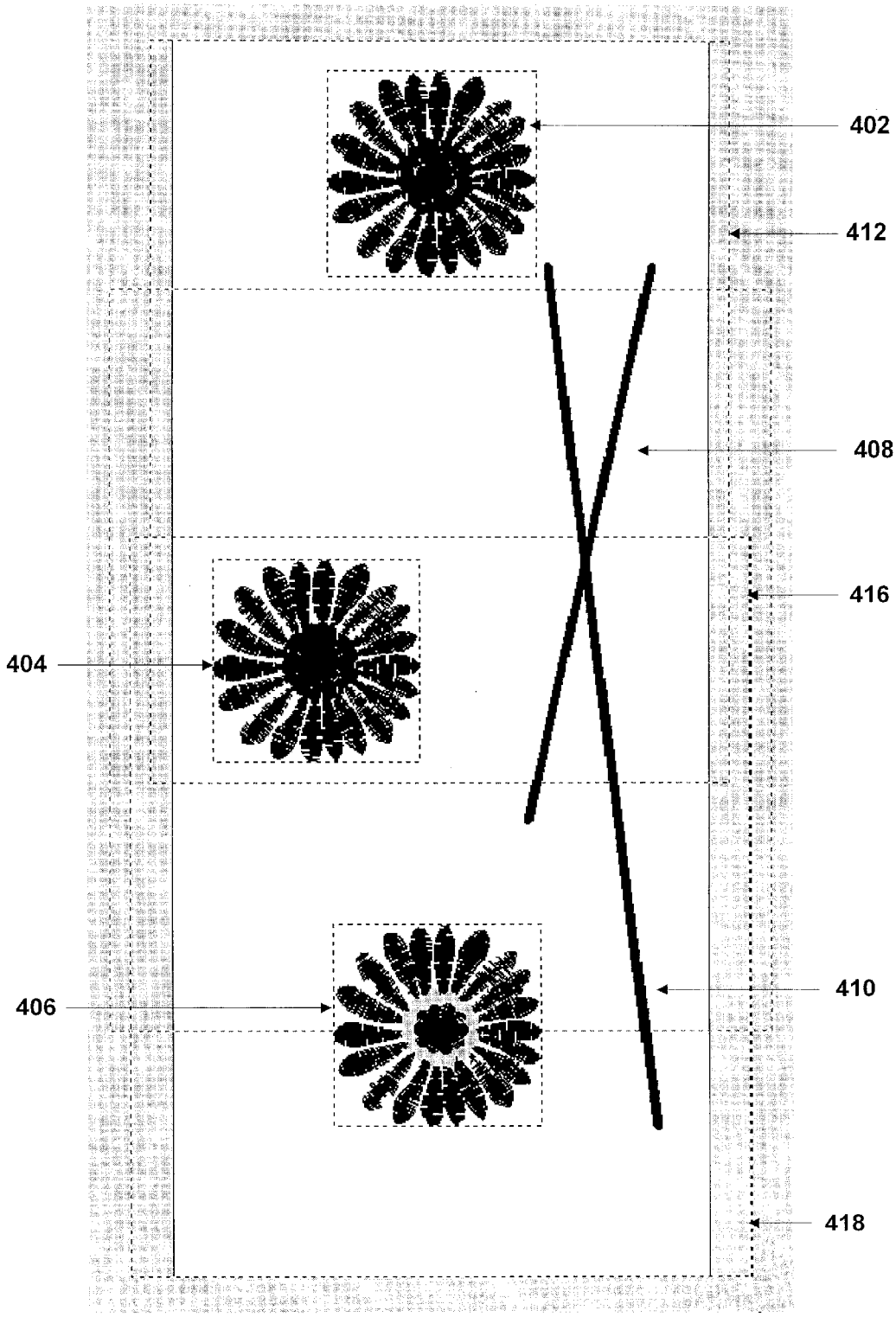
FIG. 4 is a diagram of an embroidery design and three different hoop positions which define regions which overlay the design.

The need of splitting an embroidery design into multiple regional designs frequently occurs when the design is larger than a hoop of an embroidery machine that will be used to sew the design. FIG. 4 illustrates an embroidery design 400 having three identical daisies 402, 404 and 406, a single layer, single colored line 408 and multiple layer, multiple colored line 410. Assuming that a size of a hoop 412 is represented an upper dotted rectangular line, it is noted that the design 400 is larger than hoop 412. In particular, daisies 402 and 404 fall within hoop 412 but daisy 406 is outside of the hoop 412 and parts 414 of lines 408 and 410 extend below the bottom line of hoop 412. This presents the problem of splitting the design.

In general, the problem of splitting an embroidery design into multiple regional designs presents several challenges. One difficult challenge occurs when a single color section of the design requires the continuous embroidery of more than one hoop position. For example, line 408 presents this challenge. Additionally, single colors within the embroidery may require different embroidery regions. For example, line 410 presents this challenge because it has layered colors. When these regions (e.g., lines 408 and 410) are embroidered using a region-by-region embroidery method (e.g., if hoop 412 is embroidered followed by embroidering the design outside of the hoop 412), each entire region is embroidered sequentially, one at a time. When a second region is embroidered after a first region, any overlap created by the second region embroidering over the first region must be considered. This is due to the fact that a color/layer which is embroidered under another color/layer in the first region should not be embroidered on top of the other color in the second region because this would result in an inaccurate appearance. For example, line 410 would look different within hoop size 412 as compared to below hoop 412.

According to one preferred embodiment of the invention, the sequence required for the division of an embroidered design into multiple regional designs, each of which is a subpart of the whole design, starts as follows:

The embroidery operator will utilize a software program, which at present has usage on a personal computer. Referring to FIG. 1, at a step 102, the operator will select the embroidery design 400 that will be divided and will store an electronic representation of it in the PC. The operator will then select or describe at a step 104 the embroidery hoops that are available to be used for the project. In particular, the size and shape of the hoop(s) and the number and placement of attachment points of the hoop(s) to the machine may be important. For example, FIG. 4 illustrates an upper rectangular hoop 412. FIG. 4 also shows that a rectangular hoop 416 may be positioned at and overlay the middle of the design 400 and a rectangular hoop 418 may be positioned at and overlay the lower portion of the design 400.

The operator may then choose at a next step 106 to allow the program to resize the design to fit in one hoop by executing a resizing routine 108. For example, the operator may choose to resize the design 400 to fit within hoop 412. One advantage to operating within a single hoop is that the removal and reinstallation of fabric into the hoop is time consuming. Alternatively, the operator may choose at step 106 to allow the program to resize the design to be smaller so that fewer regional designs and fewer hoop positions are needed to sew the design. For example, the operator may choose to resize the design 400 to fit within hoops 412 and 416. One advantage to operating within two hoops is that the removal and reinstallation of fabric into the hoop only occurs once.

The program then determines at a step 110 the orientation of the embroidery hoop(s): horizontal or vertical. This orientation is for the display purposes to the operator and to determine how the hoops will overlay the design. The program may at step 110 rotate the hoops around the image of the embroidered design on the computer display for the purpose of easy visualization by the operator.

At a step 112, the program then overlays the various hoop positions onto the design and creates a series of stitch lists, one list for each region, at a step 114. These lists will contain the stitches comprising the embroidery for regional design. For example with respect to FIG. 4, the stitch list for hoop 412 would include daisies 402 and 404 and portions of lines 408 and 410, the stitch list for hoop 416 would include daisy 404, a portion of daisy 406, line 408 and a portion of line 410, and the stitch list for hoop 418 would include daisies 404 and 406 and portions of lines 408 and 410.

At a step 114, the process proceeds with the creation of a regional design for each of the hoop placements. There are two choices at a step 116 for the regional designs: (1) region by region regional designs in which all stitches in each region are sewn, or (2) color by color regional designs in which each color for all regions is sewn before the next color is sewn.

The sequence required for the division of an embroidered design into multiple regions in a region by region method continues with step 118 and FIG. 2 as follows:

After selecting region by region analysis at a step 202, the program creates at a step 204 an internal pictorial representation of each region, called a bitmap. Bitmaps are used in computer software to represent images to users, but can serve as computational devices as well. The program constructs a bitmap, each of whose pixels are represented by a single value, 0 or 1. The dimensions, x and y, of the bitmap are determined by the size of the embroidered design, by convention described in units of 0.1 mm. The dimensions of the design are then reduced so that each pixel of the bitmap represents the approximate cross-regional width of a piece of embroidery thread, typically 0.3 mm. The user, depending on the desired thread weight, can adjust this value. These bitmaps are used during the process to evaluate the layers of embroidered stitches that have been created for the purpose of avoiding the overlap problem described above.

Next, at a step 206 the program must determine the sequence for the starting and ending color layers within the embroidery design. Starting at the first stitch of the first color, and working upward through the design, a list of all possible hoop positions (regions) that could contain the stitching is made. Since the regions of multiple-position hoops will overlap, it is probable that many of these stitches will be able to exist in more than one region. For example, in FIG. 4, the single layer, single colored line 408 appears in hoops 412, 416 and 418.

The stitching will be compared against the list for each hoop position until only one region remains that can encompass all of the stitches to this point. This region will be the first region to be embroidered. For instance, in FIG. 4, assume that the actual sequence as given in the original file of the design to be segmented is daisy 402, followed by daisy 404, followed by daisy 406. Since daisy 402 exists in the top hoop (412) only, the top hoop 412 would be bottom-most in the segmented sequence. Next, daisy 404 exists completely in a plurality of regions (e.g., hoops 412, 416 and 418) so the analysis continues with daisy 406. Daisy 406 exists only partially in the middle hoop (416). Therefore, the sequence in this analysis is: hoop 412 followed by hoop 418. Note that analysis of daisy 406 relative to bottom hoop 418 reveals that daisy 406 exists completely in bottom hoop 418.

The process repeats itself in a top-down fashion at step 208, starting with the last stitch of the last color of the design. By working backwards through the stitches in the design, ultimately only one region will allow all of the stitching thus far in this step of the process to exist.

Now that the program has discovered the starting and ending regions for the design, all colors that fit logically and physically can be copied into these regions' stitch lists, described above, at a step 210. To further explain, starting with the first color of the design, all colors that fit within the starting region will get copied there, providing that they will fit entirely within that region. Once a color that does not fit has been discovered, the color is selected and compared with the next required region at a step 212 to create a regional stitch list at a step 214. If the color fits completely that region as determined by a step 216, copying will continue with another layer at step 218. Copying of whole colors continues, as long as the sequence of the regions permits unbroken colors (colors that fit into single regions) to be copied. This process is then repeated from the top down, beginning with the last color. As the top down colors are copied into their respective regions, the bitmaps that correspond to those regions get drawn into. The resultant images will be used later. By positioning these whole colors into the regions in this manner, the program minimizes the amount of splitting required, thus minimizing visible splits in the design and the resultant 'seams' from multi-position embroidery.

Starting with a top-down analysis the colors will get placed and split where required into the correct regions. For any given color, the analysis is as follows:

If the color will fit into any region completely, then it will be placed there, and stitches for that color will be drawn into that region's bitmap. If the color will not be able to fit into any single region, then it must be split into two or more regions. Beginning with the last stitch and working top-down, the stitches are evaluated by their existence within a list of regions. As the stitches are examined, the list of regions that can contain all of the stitches of this color is narrowed down. Eventually a stitch will occur that falls outside this list of regions. This point is set as the 'crossover point' at a step 220, an indication that the stitches from this point down will need to be copied into a different region.

In addition, the stitches up until this point are analyzed for the appearance of any 'jump' stitches at a step 222. These are stitches that allow the embroidery machine to go from one major section of a design to another without leaving a trail of stitches. Since the operator will usually cut away these jump stitches, they are perfect points to split the stitch and assign a crossover point to the beginning or end of the jump stitch.

Figure 5:
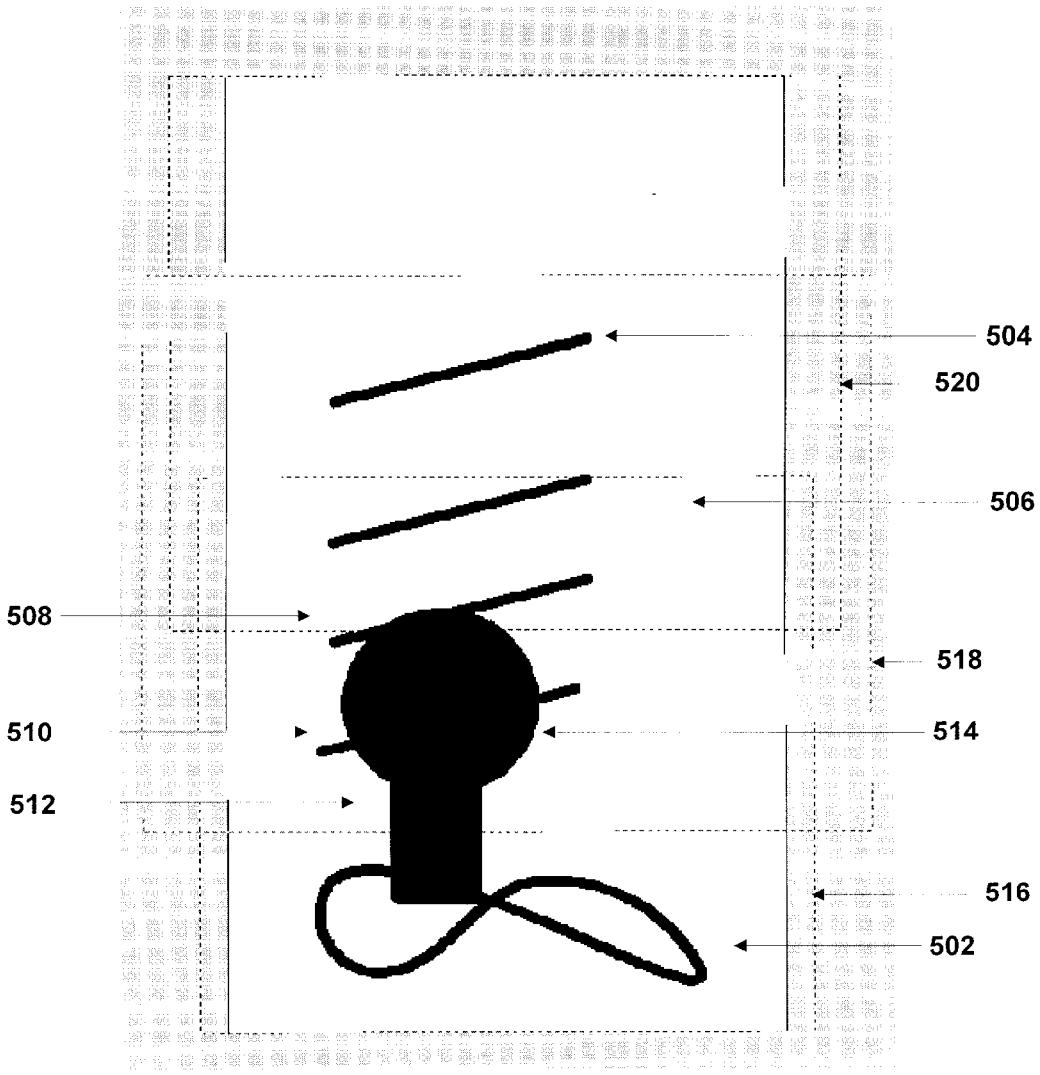
FIG. 5 is a diagram of another embroidery design and three different hoop positions which define regions which overlay the design.
Figure 6:
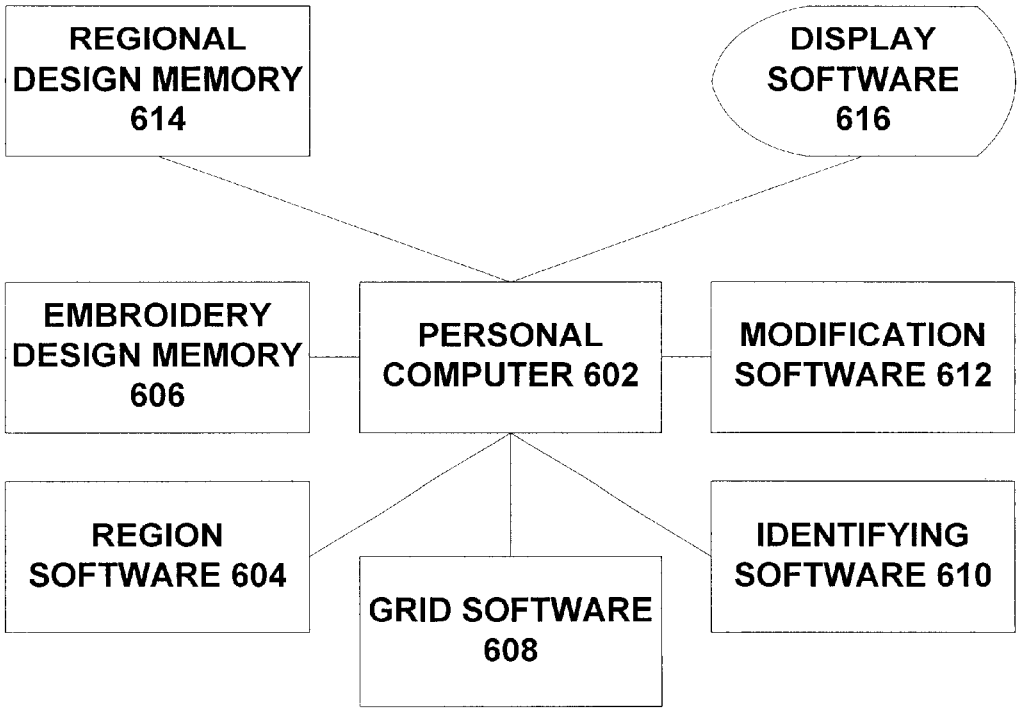
FIG. 6 is a block diagram of one preferred embodiment of the system of the invention.

The program then analyzes the stitches by comparing them to the bitmaps created for regions that will sew before the region that is being utilized. If the stitching will oversew an area that has been stitched before, the copying of stitches will stop at this point. The stitch is then compared to the bitmaps from regions that will be embroidered later, including the region being created. If any of these bitmaps indicate that the stitch currently being analyzed will not be apparent in the final design, then the stitch analysis continues. Otherwise, the region will be changed to the earliest region that can be embroidered with that stitch in it. This maintains the natural order in which the stitches are placed. For example, see FIG. 5. Assume the ordering of the layers of the objects is as follows (bottom layer to top layer): "figure eight" design 502, lines 504–510, rectangle 512 and circle 514. The correct sewing sequence for this design of FIG. 5 would be to embroider bottom region 516, then the center region 518. This can be determined by the analysis above, which shows that the first color, that of the "figure eight" design 502 must exist in the bottom region 516. The next item, the lines 504–510, could exist completely in the center region 518; however, the rectangle which must exist in the bottom region 516 would get placed out of sequence. The bottommost line 510 would oversew the rectangle, thereby creating an incorrect image. In this case, the bottommost line 510 (which is isolated because of jump stitches surrounding it) is evaluated in the following manner: Will line 510 overwrite an image sewn in a previously embroidered region? If the answer is yes (which it is in this case), then the next question is asked: Will that defect show in the final image? If that answer is no, then the line will stay in the center region. If the answer is yes, then the line will have to move to the earliest possible region, in this case, the bottom region 516.

In the example, the bottommost line stitching that could create a problem is in fact hidden completely by the circle 514, which is embroidered in the center region 518. Therefore, in this example the lines 504–510 are all embroidered in the center region. Note that no stitches end up in a top region 520 even though some of the lines 504–508 and part of circle 514 are in the top region 520.

Once all stitches have been placed in this region, the position is marked, and, if there is a next layer as determined by a step 218, another top-down analysis of the next layer is begun at 208, repeating the process until all layers of all stitches within the embroidery design have been placed into the various regions. At a step 224, the process of FIG. 2 is repeated for the next region until all regions have been analyzed.

The sequence required for the division of an embroidered design into multiple regions in a color by color method continues with step 120 (FIG. 1) and FIG. 3 as follows: After selecting color by color analysis at a step 302, the layer sequence is determined at a step 306. Each color within the design is analyzed at a step 308 in a bottom-up fashion. Each stitch within each color is compared against a list of available regions at a step 310. As the stitches are analyzed, the list of regions that can contain all the stitches thus far get narrowed at step 312 and a color stitch list is created at a step 314. Eventually, a stitch will occur that falls outside this list of regions so that a step 316 determines an incomplete fit. This point is set as the 'crossover point' by step 318, an indication that the stitches from this point down will need to be copied into a different region. Also, the stitches up until this point are analyzed for the appearance of any 'jump' stitches at a step 320. These are stitches that allow the embroidery machine to go from one major section of a design to another without leaving a trail of stitches. Since the operator will usually cut away these jump stitches, they are perfect points to adjust the crossover point to. Once a crossover point is found, stitches up to that point are copied into the region specified by the list. The process then repeats in a bottom up manner until all stitches in the design have been placed. The process of FIG. 3 is repeated for each color by a step 322.

Figure 2:
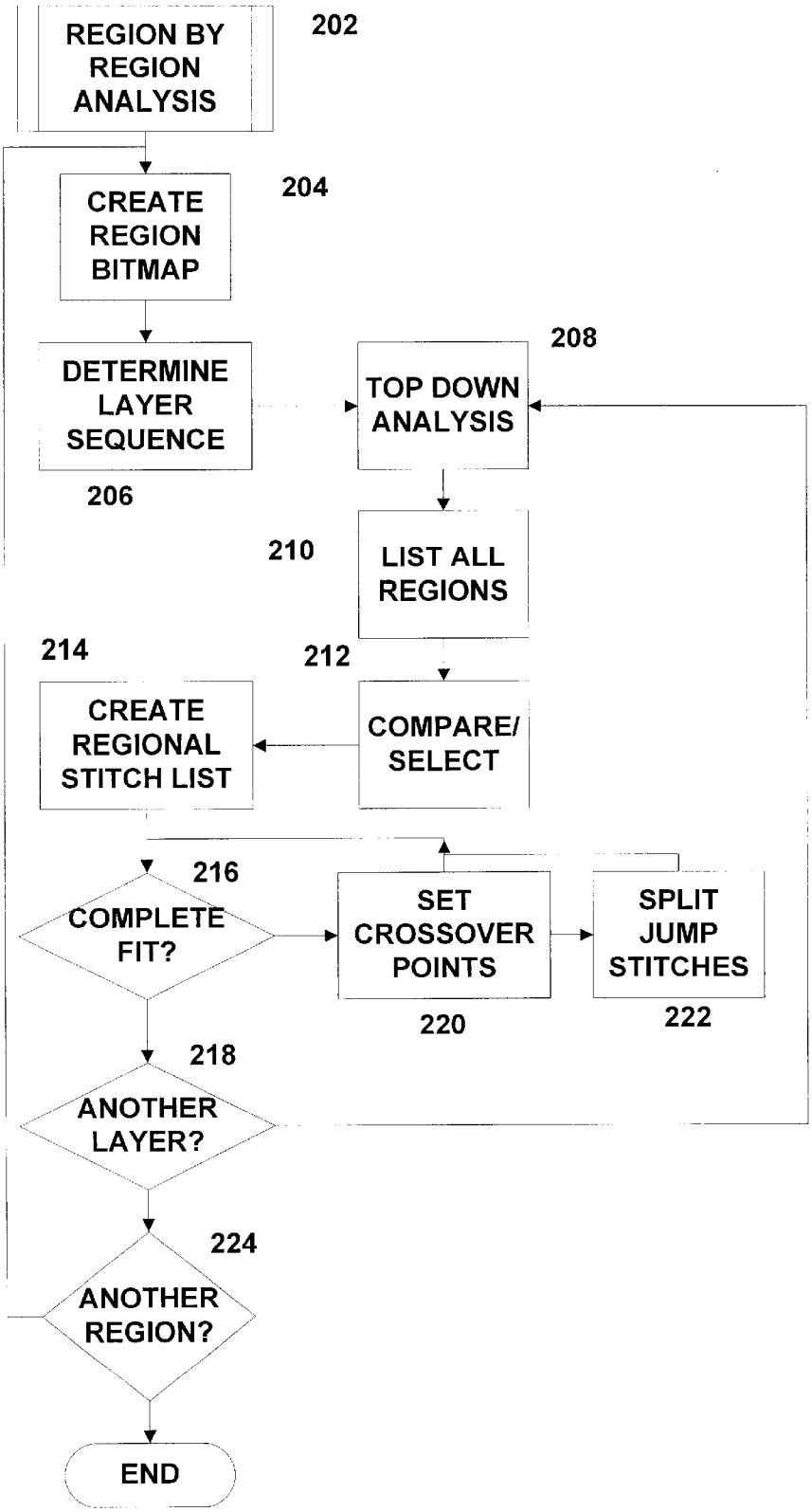
FIG. 2 is a flow chart of one preferred embodiment of the invention showing the steps of the software program, system and method of the invention for creating a collection of regional designs which can be sewn region by region.
Figure 3:
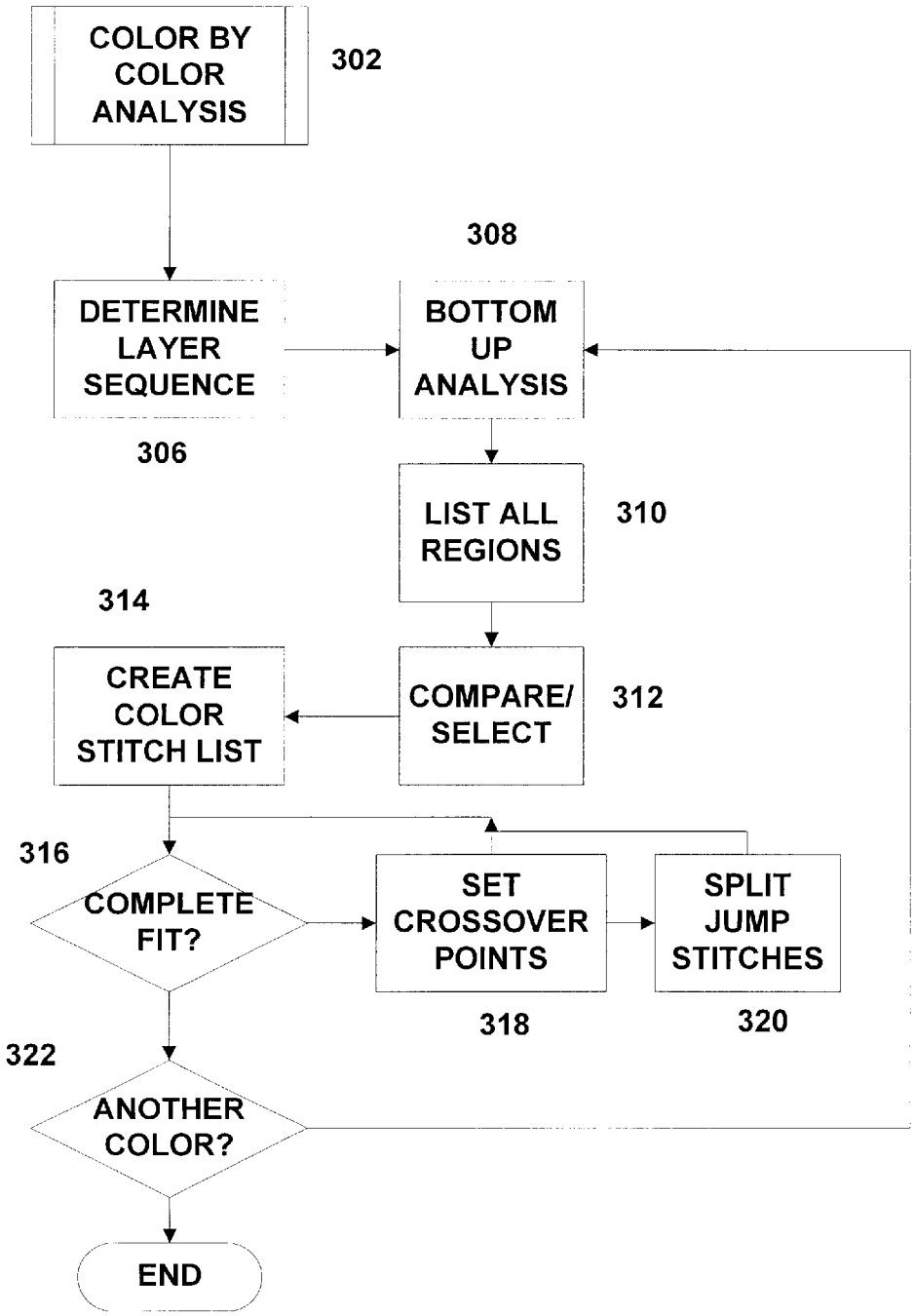
FIG. 3 is a flow chart of one preferred embodiment of the invention showing the steps of the software program, system and method of the invention for creating a collection of regional designs which can be sewn color by color.

Once the design has been split into these separate regional design by the process of FIG. 2 (region by region) or by the process of FIG. 3 (color by color), or by some other analysis, stitches are copied into separate data files and made available to the operator for retrieval and embroidery. Additionally, an automated report of the sequence of the regions to be embroidered is made available. This report can be in both display and printed form.

In one form, a personal computer 602 includes region software 604 which analyzes the stitch data of the embroidery design 606 for its ability to exist in multiple, overlapped regions (see upper portions of FIGS. 2 and 3). Grid software 608 divides the embroidery design in memory 606 to be analyzed into a plurality of grid sections or regions (see center portions of FIGS. 2 and 3). Identifying software 610 identifies each grid section having a stitch that is partially or completely underlying another stitch (see crossover and jump stitch analysis, above). Modification software 612 divides the stitches of the design into different regional designs which are stored in memory 614 as regional designs. When embroidered together, the regional designs result in the embroidered design (see lower portions of FIGS. 2 and 3). Display software 616 optionally displays the process and/or the results.

In view of the above, it will be seen that the several objects of the invention are achieved and other advantageous results attained.

When introducing elements of the present invention or the embodiment(s) thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above products, systems and methods without departing from the scope of the invention, it is intended that all matter contained in the above description and shown in the accompanying drawings shall be interpreted as illustrative and not in a limiting sense.

What is claimed is:

1. A software program for dividing an embroidery design which is larger than a hoop of an embroidery machine for sewing the embroidery design having a plurality of stitches represented by embroidery stitch data, wherein the software program divides the embroidery stitch data, the program comprising instructions for:

defining two or more regions based on a size of the hoop and/or based on a location of attachment points of the hoop to the embroidery machine;

positioning the defined regions onto the embroidery design as a function of the stitches of the embroidery design to create overlaid regions; and creating a file of embroidery stitch data that corresponds to at least one of the overlaid regions, the file comprising an executable set of instructions used by the embroidery machine to sew a regional design that corresponds to at least a portion of the embroidery design.

2. A software program for dividing an embroidery design which is larger than a hoop of an embroidery machine for sewing the embroidery design having a plurality of stitches represented by embroidery stitch data, wherein the software program divides the embroidery stitch data, the program comprising instructions for:

defining two or more regions based on a size of the hoop and/or based on a location of attachment points of the hoop to the embroidery machine;

positioning the defined regions onto the embroidery design to create overlaid regions by determining, for each stitch of the embroidery data, the overlaid region in which the stitch starts and the overlaid region in which the stitch ends and identifying stitches which fit into one of the overlaid regions; and creating a file of embroidery stitch data that corresponds to at least one of the overlaid regions and includes the identified stitch, the file comprising an executable set of instructions used by the embroidery machine to sew a regional design that corresponds to at least a portion of the embroidery design.

3. The program of claim 2 further comprising identifying jump stitches between adjacent defined regions for stitches that do not fit into one defined region and considering stitches on either side of the jump stitch as a separate stitch.

4. The program of claim 2 further comprising identifying crossover stitches between adjacent defined regions for colors of stitches that do not fit into one defined region and considering stitches on either side of the crossover stitch as a separate stitch.

5. A software program for dividing an embroidery design which is larger than a hoop of an embroidery machine for sewing the embroidery design having a plurality of stitches represented by embroidery stitch data, wherein the software program divides the embroidery stitch data, the program comprising instructions for:

defining two or more regions based on a size of the hoop and/or based on a location of attachment points of the hoop to the embroidery machine;

positioning the defined regions onto the embroidery design to create overlaid regions;

analyzing each stitch of the embroidery data to determine overlaid regions that contain each stitch; and creating a file of embroidery stitch data which corresponds to at least one of the overlaid regions, the file comprising an executable set of instructions used by the embroidery machine to sew a regional design which corresponds to at least a portion of the embroidery design, wherein the file is configured such that the machine embroiders all stitches within one overlaid region before the machine embroiders stitches of any other overlaid region.

6. The program of claim 5 wherein the analyzing repeats itself in a top down analysis of stitches of each layer of the embroidery design.

7. A software program for dividing an embroidery design which is larger than a hoop of an embroidery machine for sewing the embroidery design having a plurality of stitches represented by embroidery stitch data, wherein the software program divides the embroidery stitch data, the program comprising instructions for:

defining two or more regions based on a size of the hoop and/or based on a location of attachment points of the hoop to the embroidery machine;

positioning the defined regions onto the embroidery design to create overlaid regions;

analyzing each color of each layer of the embroidery data to determine overlaid regions that contain each color; and creating a file of embroidery stitch data that corresponds to at least one of the overlaid regions, the file comprising an executable set of instructions used by the embroidery machine to sew a regional design that corresponds to at least a portion of the embroidery design, wherein the file is configured such that the machine embroiders a first color of all stitches of all regions before the machine embroiders a next color of all stitches of all regions.

8. The program of claim 7 wherein the analyzing repeats itself in a bottom up analysis of each color of each stitch of the embroidery design.

9. A computer readable medium having computer executable instructions for performing the steps of the software program of claim 1.

10. A software program for dividing an embroidery design having a plurality of stitches represented by embroidery stitch data into predefined regions having a size based on a size of a hoop of an embroidery machine and/or based on a location of attachment points of the hoop to the embroidery machine, wherein the software program divides the embroidery stitch data, the program comprising instructions for:

separating the embroidery stitch data into sections as a function of the stitches such that each section fits within one of the predefined regions; and creating for the separated sections an executable set of instructions used by the embroidery machine to sew the embroidery design whereby the embroidery machine sews the embroidery design by sequentially executing the instructions.

11. The software of claim 10 wherein creating comprises creating for all stitches in each section an executable set of instructions used by the embroidery machine to sew the stitches of each section whereby the embroidery machine sews the embroidery design by sequentially executing the instructions for all sections.

12. The software of claim 10 wherein creating comprises creating for each color of the embroidery design an executable set of instructions used by the embroidery machine to sew each color of the embroidery design whereby the embroidery machine sews the embroidery design by sequentially executing the instructions for all colors.

13. A computer readable medium having computer executable instructions for performing the steps of the software program of claim 10.

14. A system for dividing an embroidery design which is larger than a hoop of an embroidery machine for sewing the embroidery design having a plurality of stitches represented by embroidery stitch data, wherein the system divides the embroidery stitch data, the system comprising:

a personal computer executing the following instructions:

defining two or more regions based on a size of the hoop and/or based on a location of attachment points of the hoop to the embroidery machine;

positioning the defined regions onto the embroidery design as a function of the stitches of the embroidery design to create overlaid regions; and creating a file of embroidery stitch data that corresponds to at least one of the overlaid regions, the file comprising an executable set of instructions used by the embroidery machine to sew a regional design that corresponds to at least a portion of the embroidery design.

15. A system for dividing an embroidery design which is larger than a hoop of an embroidery machine for sewing the embroidery design having a plurality of stitches represented by embroidery stitch data, wherein the system divides the embroidery stitch data, the system comprising:

a personal computer executing the following instructions:

defining two or more regions based on a size of the hoop and/or based on a location of attachment points of the hoop to the embroidery machine;

positioning the defined regions onto the embroidery design to create overlaid regions by determining, for each stitch of the embroidery data, the overlaid region in which the stitch starts and the overlaid region in which the stitch ends and identifying stitches which fit into one of the overlaid regions; and creating a file of embroidery stitch data that corresponds to at least one of the overlaid regions and includes the identified stitch, the file comprising an executable set of instructions used by the embroidery machine to sew a regional design that corresponds to at least a portion of the embroidery design.

16. The system of claim 15 wherein the computer further executes identifying jump stitches between adjacent defined regions for stitches that do not fit into one defined region and considering stitches on either side of the jump stitch as a separate stitch.

17. The system of claim 15 wherein the computer further executes identifying crossover stitches between adjacent defined regions for colors of stitches that do not fit into one defined region and considering stitches on either side of the crossover stitch as a separate stitch.

18. A system for dividing an embroidery design which is larger than a hoop of an embroidery machine for sewing the embroidery design having a plurality of stitches represented by embroidery stitch data, wherein the system divides the embroidery stitch data, the system comprising:

a personal computer executing the following instructions:

defining two or more regions based on a size of the hoop and/or based on a location of attachment points of the hoop to the embroidery machine;

positioning the defined regions onto the embroidery design to create overlaid regions;

analyzing each stitch of the embroidery data to determine overlaid regions that contain each stitch; and creating a file of embroidery stitch data which corresponds to at least one of the overlaid regions, the file comprising an executable set of instructions used by the embroidery machine to sew a regional design which corresponds to at least a portion of the embroidery design, wherein the file is configured such that the machine embroiders all stitches within one overlaid region before the machine embroiders stitches of any other overlaid region.

19. The system of claim 18 wherein the analyzing repeats itself in a top down analysis of stitches of each layer of the embroidery design.

20. A system for dividing an embroidery design which is larger than a hoop of an embroidery machine for sewing the embroidery design having a plurality of stitches represented by embroidery stitch data, wherein the system divides the embroidery stitch data, the system comprising:

a personal computer executing the following instructions:

defining two or more regions based on a size of the hoop and/or based on a location of attachment points of the hoop to the embroidery machine;

positioning the defined regions onto the embroidery design to create overlaid regions;

analyzing each color of each layer of the embroidery data to determine overlaid regions that contain each color; and creating a file of embroidery stitch data that corresponds to at least one of the overlaid regions, the file comprising an executable set of instructions used by the embroidery machine to sew a regional design that corresponds to at least a portion of the embroidery design, wherein the file is configured such that the machine embroiders a first color of all stitches of all regions before the machine embroiders a next color of all stitches of all regions.

21. The system of claim 20 wherein the analyzing repeats itself in a bottom up analysis of each color of each stitch of the embroidery design.

22. The program of claim 1 wherein positioning includes analyzing the embroidery stitch data to create the overlaid regions.

23. The system of claim 14 wherein positioning includes analyzing the embroidery stitch data to create the overlaid regions.

* * * * *

UNITED STATES PATENT AND TRADEMARK OFFICE

CERTIFICATE OF CORRECTION

PATENT NO. : 6,600,966 B1
DATED : July 29, 2003
INVENTOR(S) : Bailie

It is certified that error appears in the above-identified patent and that said Letters Patent is hereby corrected as shown below:

Title page,
Item [57], ABSTRACT,
Line 11, "design. In" should read -- design. The embroidery machine sews the embroidery design by sequentially executing the instructions for all regional designs. In --

Column 1,
Line 21, "smaller that the design." should read -- smaller than the design. --

Column 4,
Line 53, "One advantage" should read -- One disadvantage --

Column 7,
Line 59, "regional design" should read -- regional designs --

Signed and Sealed this

Fourteenth Day of October, 2003

JAMES E. ROGAN
*Director of the United States Patent and Trademark Office*